US006863503B2

(12) United States Patent
Matsuda et al.

(10) Patent No.: US 6,863,503 B2
(45) Date of Patent: Mar. 8, 2005

(54) VARIABLE CAPACITY COMPRESSOR

(75) Inventors: Mikio Matsuda, Nishio (JP); Motohiko Ueda, Okazaki (JP)

(73) Assignees: Nippon Soken, Inc., Aichi-ken (JP); Denso Corporation, Kariya (JP)

( * ) Notice: Subject to any disclaimer, the term of this patent is extended or adjusted under 35 U.S.C. 154(b) by 53 days.

(21) Appl. No.: 10/232,306

(22) Filed: Sep. 3, 2002

(65) Prior Publication Data

US 2003/0044289 A1 Mar. 6, 2003

(30) Foreign Application Priority Data

Sep. 6, 2001 (JP) ..... 2001-270919

(51) Int. Cl.[7] ..... F04B 1/26
(52) U.S. Cl. ..... 417/222.1; 417/222.2
(58) Field of Search ..... 417/222.1, 222.2, 417/223, 230

(56) References Cited

U.S. PATENT DOCUMENTS

| | | | | |
|---|---|---|---|---|
| 4,880,356 A | | 11/1989 | Suzuki et al. | 417/53 |
| 4,932,843 A | | 6/1990 | Itoigawa et al. | 417/222.1 |
| 5,603,610 A | * | 2/1997 | Kawaguchi et al. | 417/222.2 |
| 5,681,150 A | * | 10/1997 | Kawaguchi et al. | 417/222.2 |
| 5,713,725 A | * | 2/1998 | Kawaguchi et al. | 417/222.2 |
| 5,971,716 A | * | 10/1999 | Ota et al. | 417/222.2 |
| 6,164,925 A | * | 12/2000 | Yokomachi et al. | 417/222.2 |
| 6,213,728 B1 | * | 4/2001 | Kato et al. | 417/222.2 |
| 6,224,348 B1 | * | 5/2001 | Fukanuma et al. | 417/222.2 |
| 6,280,152 B1 | * | 8/2001 | Sugiura et al. | 417/269 |
| 6,283,722 B1 | * | 9/2001 | Takenaka et al. | 417/222.2 |
| 6,290,468 B1 | * | 9/2001 | Kato et al. | 417/222.2 |
| 6,318,971 B1 | * | 11/2001 | Ota et al. | 417/222.2 |
| 6,544,004 B2 | * | 4/2003 | Fujii et al. | 417/222.2 |

FOREIGN PATENT DOCUMENTS

| | | | |
|---|---|---|---|
| JP | A-64(1)-45978 | | 2/1989 |
| JP | A-1-190972 | | 8/1989 |
| JP | A-2-49982 | | 2/1990 |
| JP | A-5-87048 | | 4/1993 |
| JP | 2001-132634 | * | 5/2001 |

* cited by examiner

*Primary Examiner*—Justine R. Yu
*Assistant Examiner*—William H. Rodriguez
(74) *Attorney, Agent, or Firm*—Posz & Bethards, PLC

(57) ABSTRACT

A variable capacity compressor like a swash plate type where a pressurized fluid is fed to a control pressure chamber such as a swash plate chamber to apply a backpressure to a piston etc. and the backpressure is changed by the capacity control valve, wherein the valve is streamlined and reduced in cost by providing a simple valve such as a two-way solenoid valve as a capacity control valve in a feed path to or discharge path from the control pressure chamber. By controlling the duty ratio of the valve, it is possible to smoothly change the capacity of the compressor. Further, a torque sensor is provided at a drive shaft, and the valve is controlled by a control unit to change the discharge capacity of the compressor in accordance with that detection value.

6 Claims, 11 Drawing Sheets

VARIABLE CAPACITY COMPRESSOR

BACKGROUND OF THE INVENTION

1. Field of the Invention

The present invention relates to variable capacity compressor for compressing a fluid such as a refrigerant in a vehicular air-conditioning system.

2. Description of the Related Art

As described for example in Japanese Unexamined Patent Publication (Kokai) No. 1-190972 and Japanese Unexamined Patent Publication (Kokai) No. 2-49982, in a variable capacity compressor for an air-conditioning system installed in a vehicle in the past, the temperature inside the vehicle has been kept constant by detecting the suction pressure of the refrigerant or the exhaust temperature of the cold air, while the suction pressure or exhaust temperature have been kept constant by changing the capacity of the compressor (discharge capacity, that is, amount of discharge per revolution of the drive shaft or per unit time) by a capacity control valve. Recently, however, to improve the fuel economy of the engine and the drivability of the vehicle, there have been strong demands for controlling the capacity of the compressor from the engine side or the vehicle side in accordance with the operating state of the engine or the running state of the vehicle.

To meet with these demands, in another prior art, for example, a capacity control device of a variable capacity compressor described in Japanese Unexamined Patent Publication (Kokai) No. 5-87048, in addition to such a capacity control valve, a solenoid valve operating by an electrical signal input from the outside is provided. Small capacity operation is forced from the outside through this solenoid valve so as to prevent a sharp rise in the torque at the time of startup of the compressor and thereby reduce the shock given to the vehicle. Further, in the method of control of a variable capacity compressor described in Japanese Unexamined Patent Publication (Kokai) No. 1-45978, a means has been proposed for changing the set suction pressure of the capacity control valve from the outside using a solenoid valve etc. so as to reduce the capacity of the compressor and lighten the load of the engine at the time of vehicle acceleration etc.

The problem common to these prior art is that the capacity control valve used is complicated in structure and therefore becomes large in size. Further, due to the same reason, the cost of the compressor rises or the compressor as a whole becomes larger, so a large space is required in the engine compartment of the vehicle for installing the compressor. Further, in the prior art, since the magnitude of the torque generated due to the operation of the compressor was not known, the engine could not be operated under the optimal conditions, so the fuel economy of the engine could not be sufficiently improved. Alternatively, the capacity of the compressor could not be freely controlled in accordance with the running state of the vehicle, so when the engine load became larger such as during acceleration of the vehicle or when climbing a slope, the capacity of the compressor could not be made smaller. Therefore, the effect of control of the compressor in improving the drivability of the vehicle could not be sufficiently raised.

SUMMARY OF THE INVENTION

An object of the present invention is to solve these problems in the prior art by a novel means and enable free control of the capacity of a compressor in accordance with the running state of the vehicle or the operating state of the engine so as to improve the engine fuel economy and prevent as much as possible deterioration of the vehicle drivability due to compressor operation.

Another object of the present invention is to avoid a rise in cost or an increase in the compressor size due to use of a capacity control valve of a complicated structure and to facilitate the installation of the compressor into the engine compartment of the vehicle and its design itself.

In the present invention, as the capacity control valve for changing the pressure of the fluid acting on a control pressure chamber such as a swash plate chamber in a variable capacity compressor like a swash plate type, a simple valve for just opening and closing a passage is provided at one of a feed path of a high-pressure fluid to the control pressure chamber and a discharge path of the high-pressure fluid from the control pressure chamber and a constricted passage is formed at the other, so the capacity control valve itself and the compressor as a whole are made smaller in size and lower in cost and installation of the compressor becomes easier. Further, a torque sensor is attached to the shaft of this variable capacity compressor and a detection value of the torque sensor input to a control unit. The valve is controlled to change the capacity of the compressor in accordance with the detection value of the torque sensor. Due to this, it becomes possible to control the torque for driving the compressor to a suitable value.

As the high-pressure fluid, it is possible to use a pressurized fluid in the discharge chamber. Further, the compressor gives preferable results when used as a compressor for a refrigerant for an air-conditioning system installed in a vehicle.

Specifically, as the valve for control of the capacity control valve, a two-way solenoid valve is preferable. Further, it is possible to provide an electronic control unit for controlling the operation of the valve. In this case, if controlling the duty ratio of the valve by this control unit, it is possible to steplessly change the capacity of the compressor.

Further, by linking the control unit of the compressor with a control unit of the vehicle or engine, it becomes possible to change the capacity of the compressor in accordance with at least the running state of the vehicle or the operating state of the engine, so it is possible to improve the drivability of the vehicle and the fuel economy of the engine. AS opposed to this, it becomes possible to control the output of the engine or the running state of the vehicle in accordance with the drive torque of the compressor.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
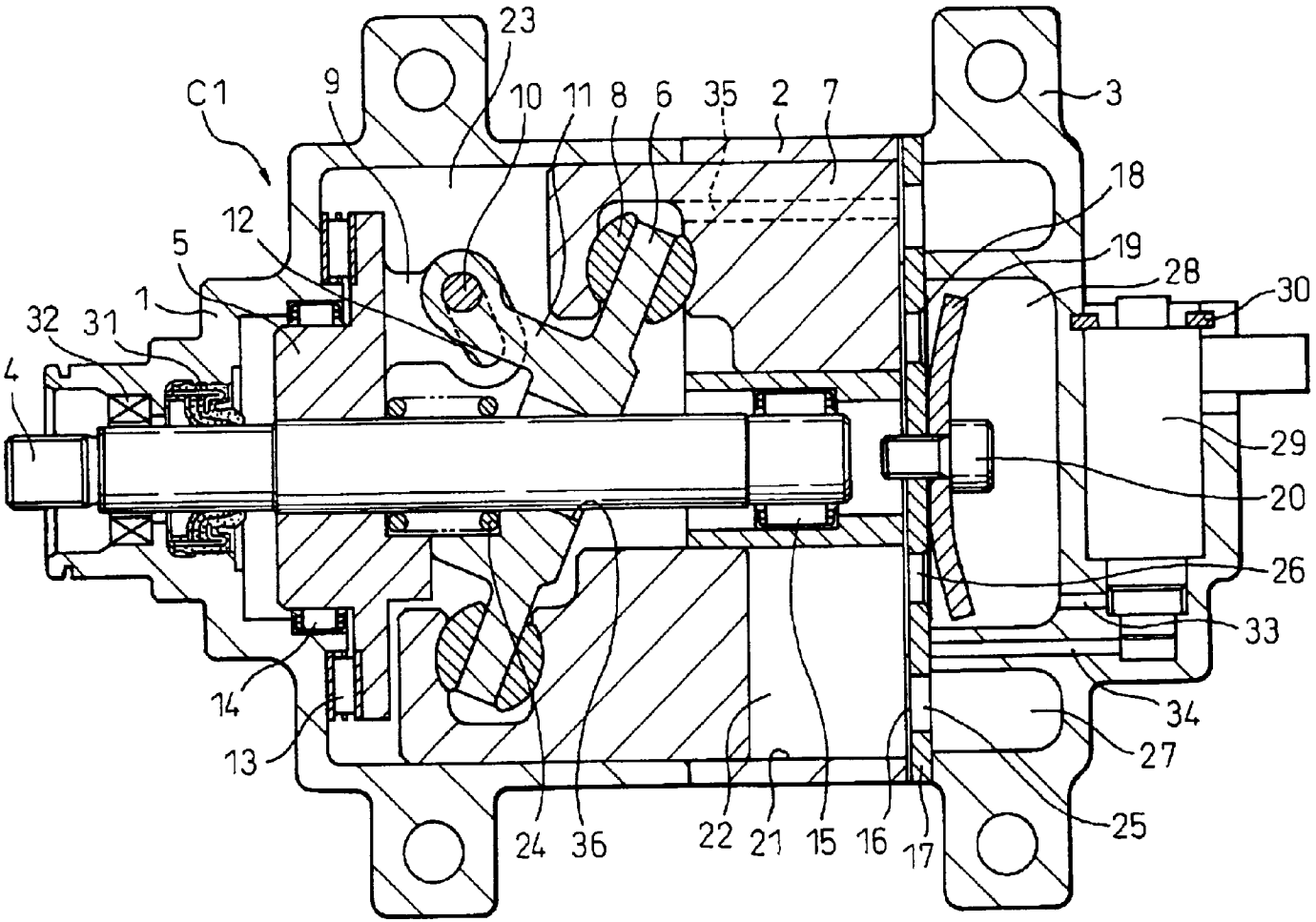
FIG. 1 is a longitudinal sectional view of the structure of a swash plate type variable capacity compressor according to a first embodiment of the invention in the state of operation at maximum capacity.

The sectional structure of a swash plate type variable capacity compressor C1 is shown as a first embodiment of the present invention. In FIG. 1, reference numeral 1 is a front housing, 2 a middle housing, and 3 a rear housing. These are joined by means such as not shown through bolts. Reference numeral 4 is a shaft serving as an input shaft, 5 a drive plate attached to the same, and 6 a generally disk-shaped swash plate loosely inserted so as to be able to freely tilt with respect to the shaft 4.

Reference numeral 7 is a piston engaged with a periphery of the swash plate 6 and able to reciprocate in a direction parallel to the shaft 4. There are for example five pistons provided at equal intervals around the shaft 4. Note that these pistons do not necessarily have to be provided at equal intervals around the shaft 4. Reference numeral 8 indicates a semispherical shoe for reducing wear. This fits into a semispherical recess formed in the end of a piston 7 and causes the piston 7 to slidingly engage with the periphery of the swash plate 6. A pair of two of these slidingly sandwich the swash plate 6. Reference numeral 9 is an arm formed so as to project out from the drive plate 5. Corresponding to this, the swash plate 6 is provided, projecting out from it, an arm-like guide pin holder 11 provided with a guide pin 10 at its front end. This guide pin 10 engages with a cam-shaped link groove 12 formed at the front end of the arm 9.

Reference numeral 13 is a thrust bearing supporting the shaft 4 through the drive plate 5 in the axial direction. Reference numerals 14 and 15 are radial bearings axially supporting the shaft 4 in the radial direction. Reference numeral 16 is a reed valve-shaped suction valve provided at a valve plate 17, while 18 is a discharge valve. Reference numeral 19 is a valve stop plate for preventing damage to the discharge valve 18, while 20 is a bolt for attaching the same.

Reference numeral 21 is a cylinder—a plurality of which are formed in parallel at the middle housing 2 so that the above-mentioned pistons 7 can be slidingly inserted in them. Reference numeral 22 is a working chamber formed by a front end face of a piston 7 at the inside of each cylinder 22 for compressing a fluid like a refrigerant for an air-conditioning system. Reference numeral 23 is a swash plate chamber for accommodating the swash plate 6 etc. In general, this should be called a "control pressure chamber". It is formed in the front housing 1 as a closed space.

Reference numeral 24 is a spring which biases the swash plate 6 so that the tilt angle of the swash plate 6 (angle formed by swash plate 6 with imaginary plane perpendicularly intersecting the shaft 4) become smaller by being loosely fit over the shaft 4 and constantly pressing the swash plate 6 in the right direction of the axial direction in FIG. 1. Further, the biasing force of the spring 24 pushes all of the pistons 7 in the right direction of the axial direction through the swash plate 6 to bias them toward top dead center so that the strokes of the pistons 7 become the minimum.

Note that reference numeral 25 is a suction port opening to the valve plate 17 and opened and closed by the above-mentioned suction valve 16, 26 is a discharge port opened and closed by the discharge valve 18, 27 is a suction chamber formed in a ring at the inside of the rear housing 3, and 28 is a discharge chamber formed at the center of the rear housing.

A capacity control valve 29 is attached at the rear housing 3 so as to change the discharge capacity of the swash plate type variable capacity compressor C1. The capacity control valve 29 is a so-called two-way valve of a solenoid drive system. As illustrated by its detailed structure later, this is an inexpensive valve having an extremely simple structure just sufficient to enable the feed path of the control pressure fluid to be repeatedly opened and closed so as to control the duty ratio. Reference numeral 30 indicates a circlip for securing the control valve 29 in an attachment hole formed in the rear housing 3.

Reference numeral 31 is a shaft seal provided at the shaft 4 for sealing the swash plate chamber 23. A torque sensor 32, one of the characterizing features of the variable capacity compressor of the present invention, is provided at its outside. The torque sensor 32 detects the magnitude of the torque acting on the shaft 4. It may itself be a known one. For example, it is possible to use a magnetostriction type.

Reference numeral 33 is a communicating hole provided in the rear housing 3 for introducing part of the high-pressure (discharge pressure) refrigerant (in general, a fluid) in the discharge chamber 28 to the capacity control valve 29, while 34 is a control pressure feed hole provided for feeding into the swash plate chamber 23 control pressure formed by reducing the pressure of the discharge pressure by the control valve 29. Further, the middle housing 2 between the swash plate chamber 23 and the suction chamber 27 is provided with a small diameter constricted passage 35 giving resistance to the flow of the refrigerant. Note that reference numeral 36 is a guide hole formed in the center of the swash plate 6 for loosely fitting the shaft 4 and is shaped so as to enable the swash plate 6 to tilt with respect to the shaft 4.

Next, the basic compression action of the swash plate type variable capacity compressor C1 of the first embodiment will be explained. The drive plate 5 drives the rotation of the swash plate 6 through the arm 9 and the guide pin holder 11 by the shaft 4 being driven to rotate from the not shown vehicle engine through a belt transmission system etc. (further interposition of an electromagnetic clutch etc. also possible). The swash plate 6 rotates while maintaining a tilt angle designated by a control unit as explained later. The rear ends of the pistons 7 engage with the periphery of the common swash plate 6, so when the swash plate 6 rocks largely in accordance with its tilt angle simultaneously with rotation, the pistons 7 reciprocate in the cylinders 21 by receiving the axial direction component of the rocking motion of the swash plate 6. Therefore, each piston 7 in the suction stroke expands its working chamber 22, so the refrigerant is sucked from the suction chamber 27 through the suction valve 16 into the working chamber 22. Further, each piston 7 in the discharge stroke reduces its working chamber 22, so the refrigerant is compressed in the working chamber 22 to become a high-pressure, pushes open the discharge valve 18, and is discharged into the discharge chamber 28.

In the swash plate variable capacity compressor C1, due to the above-mentioned structure, the swash plate 6 becomes variable in tilt angle and is biased in the right direction in FIG. 1 at all times by the spring 24. The biasing force in the right direction due to the spring 24 is transmitted to all of the pistons 7. Further, each piston 7 in the compression stroke is acted upon by a large force in the left direction caused in reaction when it compresses the refrigerant in the working chamber 22, while each piston 7 in the suction stroke is acted upon by a relatively small force in the right direction caused in reaction when the refrigerant is sucked into the working chamber 22. Further, by the pressure inside the swash plate chamber (control pressure chamber) 23 acting as backpressure at all of the pistons 7, these receive equal force in the right direction. The swash plate 6 is linked with all of the pistons 7 in the axial direction, so the center of the swash plate 6 moves in the axial direction until a position where the axial direction forces acting on the pistons 7 balance as a whole. A tilt angle in accordance with that position is maintained.

Figure 2:
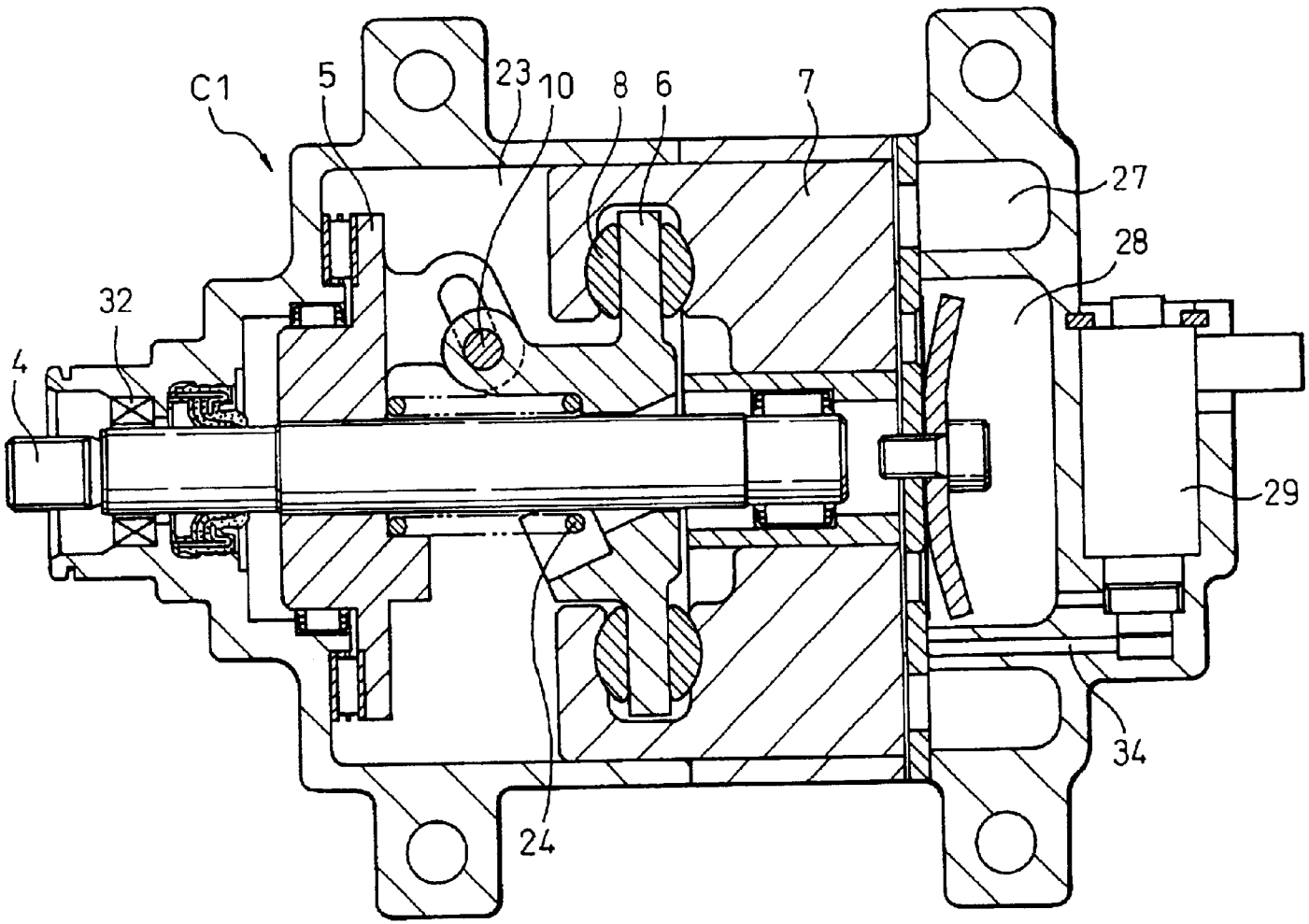
FIG. 2 is a longitudinal sectional view of the state of operation of the compressor shown in FIG. 1 at minimum capacity.

Therefore, if operating the capacity control valve 29 to change the pressure in the swash plate chamber 23 (control pressure), that is, the backpressure of all of the pistons 7, the tilt angle of the swash plate 6 changes, the strokes of the pistons 7 change all together, and the capacity of the swash plate type variable capacity compressor C1 changes steplessly. That is, if the pressure of the swash plate chamber 23 is lowered, the tilt angle of the swash plate 6 becomes greater, so the strokes of the pistons 7 become larger and the capacity of the compressor C1 becomes larger. FIG. 1 shows the operating state where the capacity becomes maximum. As opposed to this, if the pressure of the swash plate chamber 23 is raised, the tilt angle of the swash plate 6 and the strokes of the pistons 7 become smaller and the capacity of the compressor C1 becomes smaller. FIG. 2 shows the operating state where the tilt angle of the swash plate 6 becomes minimum and the capacity becomes substantially zero. In the operating state shown in FIG. 2, none of the pistons 7 reciprocate at the top dead center position.

In the swash plate type variable capacity compressor C1 of the first embodiment, the capacity control valve 29 used for changing the pressure of the swash plate chamber 23 is a two-way solenoid valve—a simple valve able only to open and close a flow path. This action and the configuration of the related parts are shown schematically in FIG. 3 and FIG. 4. In these figures, reference numeral 37 indicates a control unit for a vehicle or engine, while 3 indicates a control unit for a compressor C1. The control unit 38 receives as input a signal of the torque of the compressor C1 detected by the above-mentioned torque sensor 32. The control units 37 and 38 are configured as electronic control units (ECU) provided with microcomputers. Signals are exchanged between the two. Needless to say, the two may be formed integrally.

Figure 3:
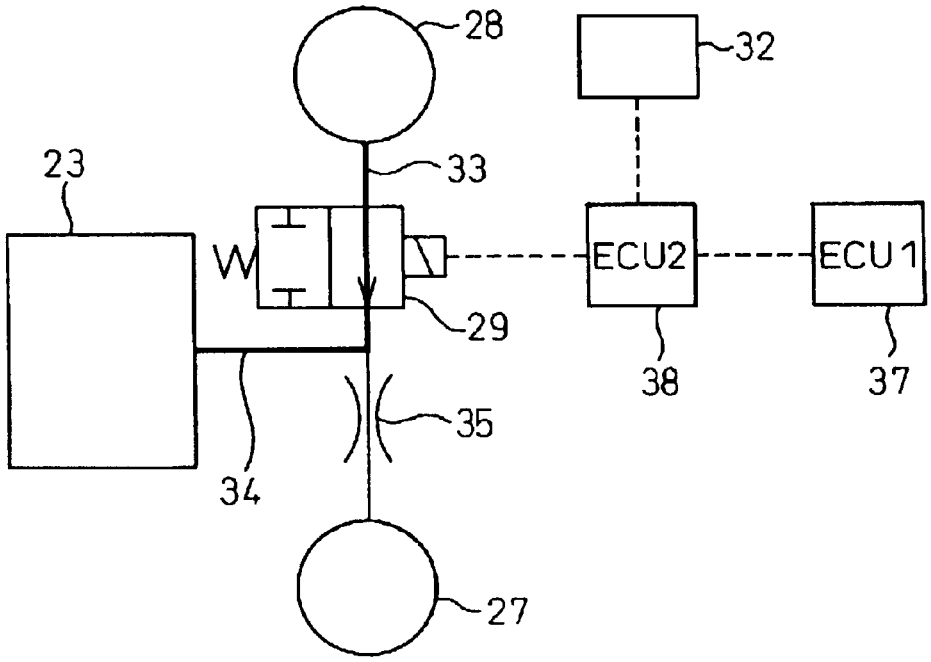
FIG. 3 is a schematic view of the specific operation of a compressor corresponding to the state of operation of FIG. 2.

The control unit 38 supplies current of two values, ON and OFF, as a drive signal to the capacity control valve 29. That is, it supplies a current of a predetermined magnitude or cuts it off. Due to this, the capacity control valve 29 takes one of an open position and a closed position. When the capacity control valve 29 is opened as shown in FIG. 3, part of the pressurized refrigerant in the discharge chamber 28 passes through a communicating hole 33, the capacity control valve 29, and control pressure feed hole 34 to flow into the swash plate chamber 23. Part of the refrigerant flowing into the swash plate chamber 23 passes through the narrow constricted passage 35 and flows out into the suction chamber 27. Therefore, the longer the time that the capacity control valve 29 is open, the higher the pressure of the swash plate chamber (control pressure chamber) 23. Of course, the pressure of the swash plate chamber 23 never exceeds the pressure of the discharge chamber 28. Due to the rise of the pressure in the swash plate chamber 23, the swash plate 6 moves in the right direction of the axial direction in FIG. 1 or FIG. 2. Finally, it moves to the position shown in FIG. 2, where the tilt angle of the swash plate 6 becomes close to zero (all pistons 7 reach close to top dead center). Therefore, the strokes of all of the pistons 7 become close to zero and even if the swash plate 6 rotates, none of the pistons 7 will reciprocate any longer, so the capacity of the compressor C1 becomes minimum.

Figure 4:
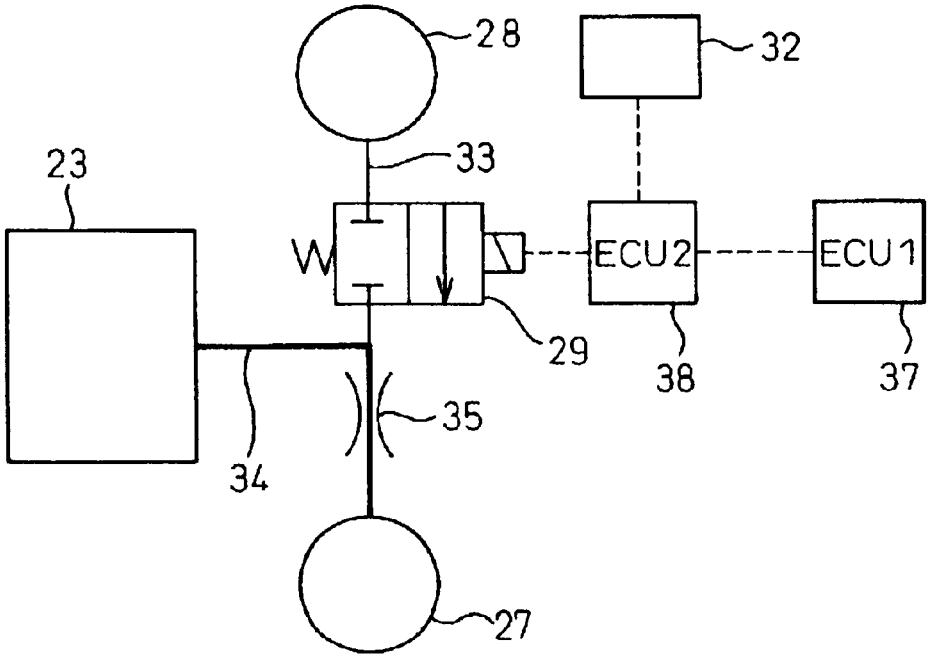
FIG. 4 is a schematic view of the specific operation of a compressor corresponding to the state of operation of FIG. 1.

FIG. 4 shows the operating state where current serving as the drive signal supplied from the control unit 38 to the capacity control valve 29 is cut off and the capacity control valve 29 closes. At this time, the refrigerant in the swash plate chamber 23 passes through the constricted passage 35 and flows into the suction chamber 27, so the backpressure of the pistons 7, that is, the pressure (control pressure) of the swash plate chamber 23, falls and the balance in the axial direction is lost. Therefore, the center of the swash plate 6 moves (retracts) in the axial direction until the position where all of the axial direction forces balance. As a result, the tilt angle of the swash plate 6 and the strokes of all of the pistons 7 become larger and in accordance with this the capacity of the compressor C1 becomes larger. The state where these become maximum is shown in FIG. 1.

Figure 7A:
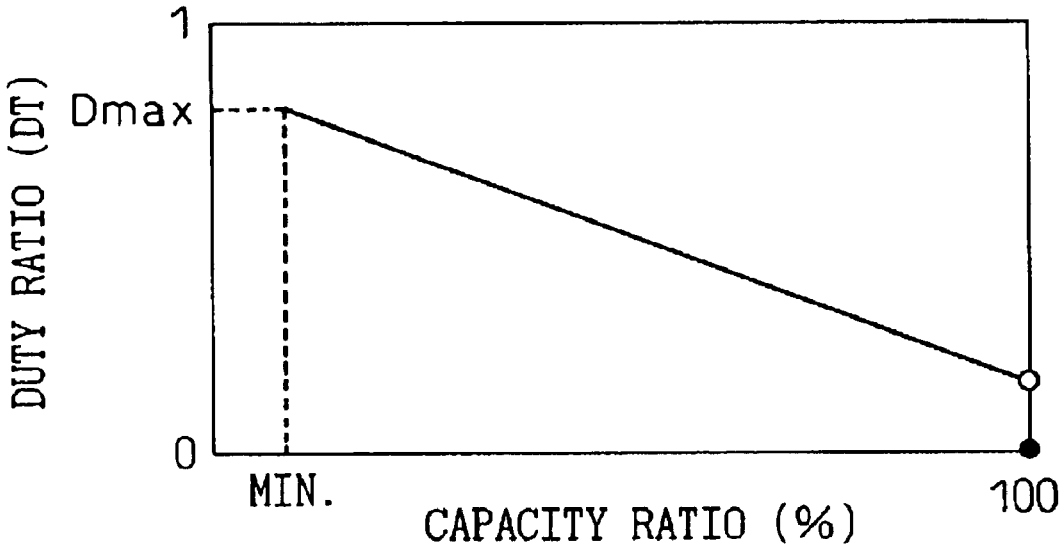
FIG. 7A is a graph of the relationship between a duty ratio of a drive signal and a capacity ratio of a compressor at the time of control of the duty ratio of a capacity control valve.
Figure 7B:
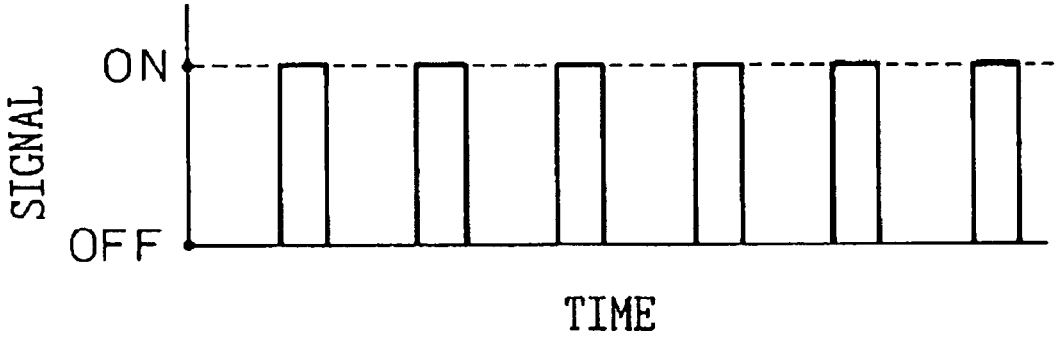
FIG. 7B is a timing chart illustrating a pulse-like drive signal.

As the method for controlling the capacity control valve 29 by the control unit 38, control of the duty ratio is preferable. In this case, the drive signal given to the capacity control valve 29 becomes a pulse-like current of repeated ON-OFF states in a short time interval as illustrated in FIG. 7B. The ON-OFF states of the drive signal correspond to the open and closed states of the capacity control valve 29. By changing the duty ratio of the pulse signal, it is possible to smoothly change the tilt angle of the swash plate 6, the strokes of the pistons 7, and the capacity of the compressor. FIG. 7A is a graph of the relationship between the duty ratio and capacity (here, shown as a ratio with respect to the maximum capacity). The relationship between the duty ratio and capacity ratio is substantially linear. It is possible to set this in the control unit 38 as a map.

In this way, when controlling the duty ratio of the capacity control valve 29, by reducing the total open time of the capacity control valve 29 per unit time, it is possible to maintain the pressure of the swash plate chamber 23 at any intermediate level lower than the maximum value, so the tilt angle of the swash plate 6 and the strokes of the pistons 7 become any intermediate values such as several fractions of their maximum values. When controlling the duty ratio, the pattern repeats of switching between the state shown in FIG. 3 and the state shown in FIG. 4 after the elapse of exactly any set short time.

Figure 5:
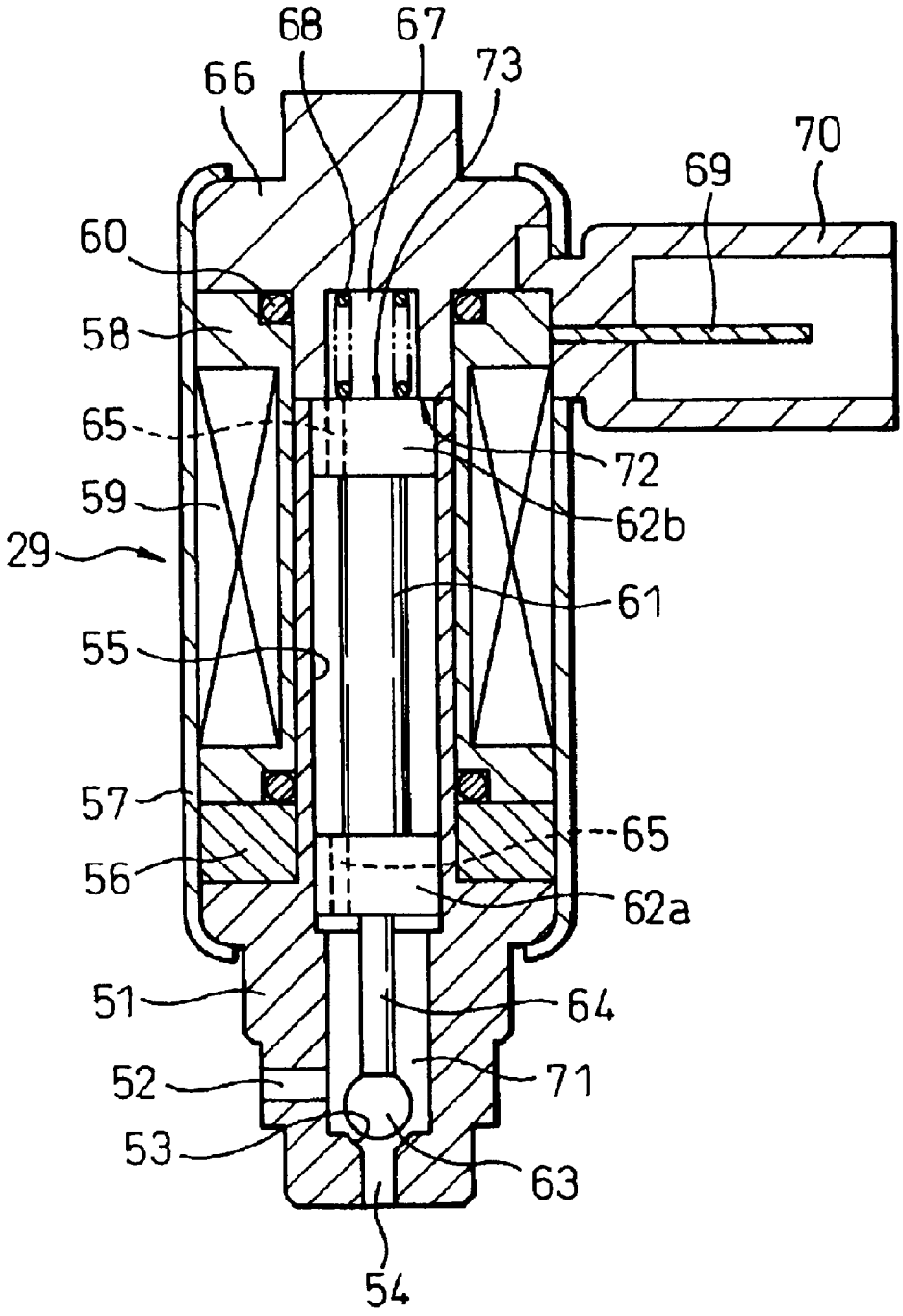
FIG. 5 is a longitudinal sectional view illustrating the structure of a capacity control valve in an open state shown in FIG. 3.
Figure 6:
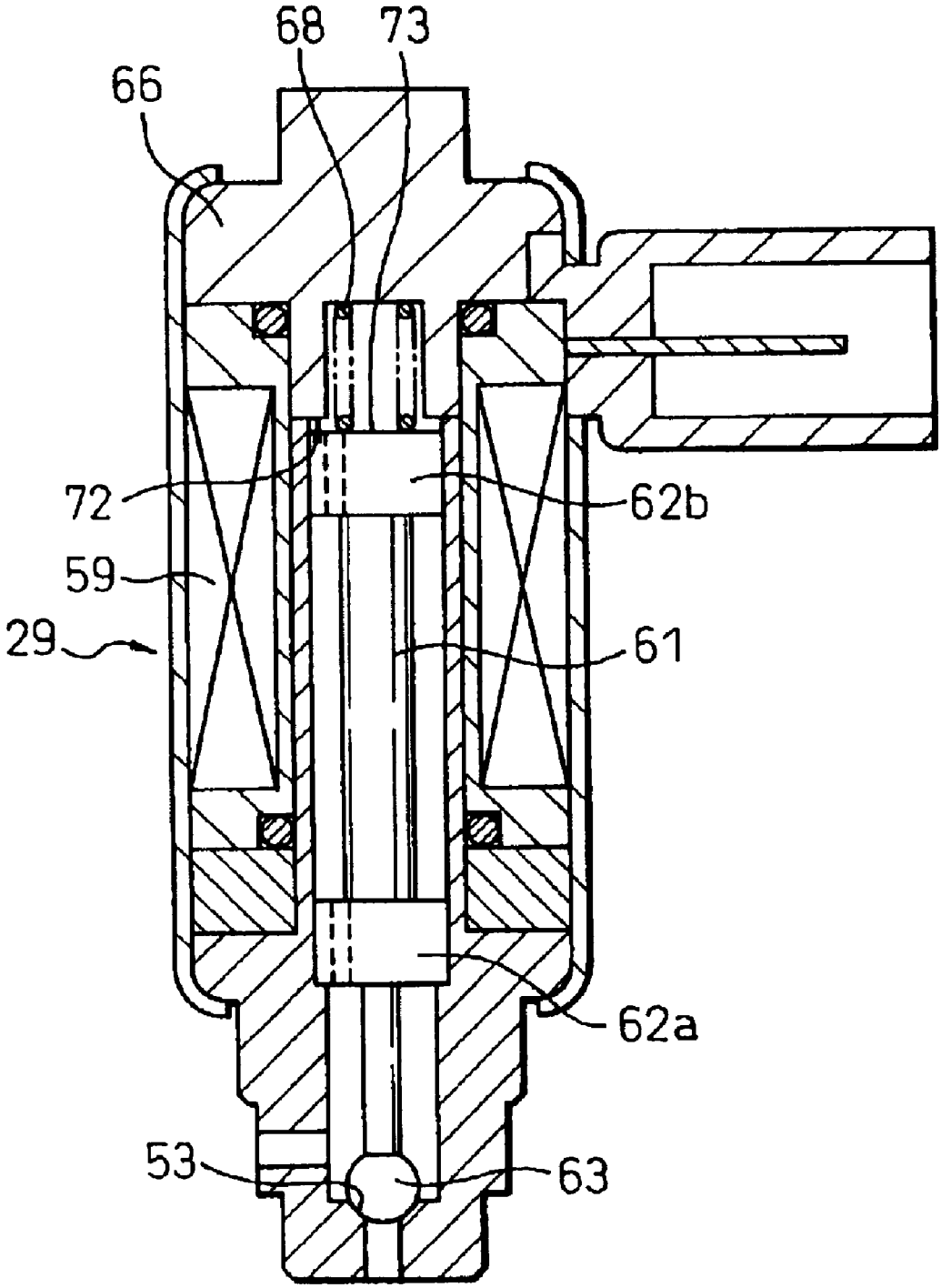
FIG. 6 is a longitudinal sectional view of a closed state of the capacity control valve shown in FIG. 5.

As the capacity control valve 29 just opening and closing in this way, it is possible to use a known inexpensive two-way solenoid valve etc. as it is. FIG. 5 and FIG. 6 show a detailed example of the structure of the capacity control valve 29. FIG. 5 shows the open state of the capacity control valve 29 corresponding to the case of FIG. 3 explained previously, while FIG. 6 shows the closed state corresponding to the case of FIG. 4.

In FIG. 5, reference numeral 51 indicates a valve body comprised of a nonmagnetic material, 52 an inflow path connected to a communicating hole 33 leading to the discharge chamber 28 shown in FIG. 1, 53 a valve seat, 54 an outflow path connected with a control pressure feed hole 34 shown in FIG. 1 and FIG. 3, 55 a guide comprised of a cylindrical surface for guiding a later explained spool, 56 a ring comprised of a magnetic material, 57 a case comprised of the same magnetic material, and 58 a bobbin comprised of a plastic or other nonmagnetic material and having a coil 59 wrapped around it. Reference numeral 60 indicates an O-ring for preventing leakage of the refrigerant, 61 a spool comprised of a magnetic material, 62*a* and 62*b* columnar parts guided by the guide 55 as parts of the spool 61, 63 a spherical valve element formed integrally with a rod 64, 66 a cap of a magnetic material, and 67 a space housing a spring 68 generating a force in a direction pushing the valve element 63 against the valve seat 53. Note that reference numeral 65 shows an equalizing hole communicating the space 67 and space 71 and equalizing their pressures, 69 is a terminal connected to the coil 59, and 70 is a terminal holder.

Since the capacity control valve 29 shown in FIG. 5 has such a structure, a magnetic circuit is formed by the cap 66, case 57, ring 56, and spool 61. FIG. 5 shows the state of power supplied to the coil 59. Due to this, the above-mentioned magnetic circuit is formed, so the top end face 73 of the columnar part 62*b* of the spool 61 is drawn to the attraction face 72 of the cap 66, whereby the valve element 63 moves away from the valve seat 53 and the capacity control valve 29 opens. In the open state, part of the high-pressure refrigerant in the discharge chamber 28 is fed into the swash plate chamber 23, so the pressure of the swash plate chamber 23 rises. This state is shown in FIG. 3 as explained above. At this time, the capacity of the swash plate type variable capacity compressor C1 falls.

The state where the power to the coil 59 is cut off, that is, the closed state of the capacity control valve 29, is shown in FIG. 6. At this time, the force by which the attraction face 72 of the cap 66 draws the top end face 73 of the spool 61 disappears, so the spool 61 and the valve element 63 descend due to the biasing force of the spring 68 and block the opening of the valve seat 53. This state corresponds to the state of the capacity control valve 29 shown in FIG. 4. Due to this, part of the refrigerant in the swash plate chamber 23 returns to the suction chamber 27 through the constricted passage 35, so the pressure in the swash plate chamber 23 falls and, as mentioned above, the swash plate 6 moves in the axial direction and the strokes become larger. As a result, the capacity of the compressor C1 increases.

That is, when opening the capacity control valve 29, the capacity of the swash plate type variable capacity compressor C1 decreases, while when closing the capacity control valve 29, the capacity of the compressor C1 increases. By simply turning the power to the coil 59 of the capacity control valve 29 on and off by a means such as the control unit 38, the pressure of the swash plate chamber 23 is increased or decreased and therefore the discharge capacity of the swash plate type variable capacity compressor C1 can be freely controlled.

Figure 8:
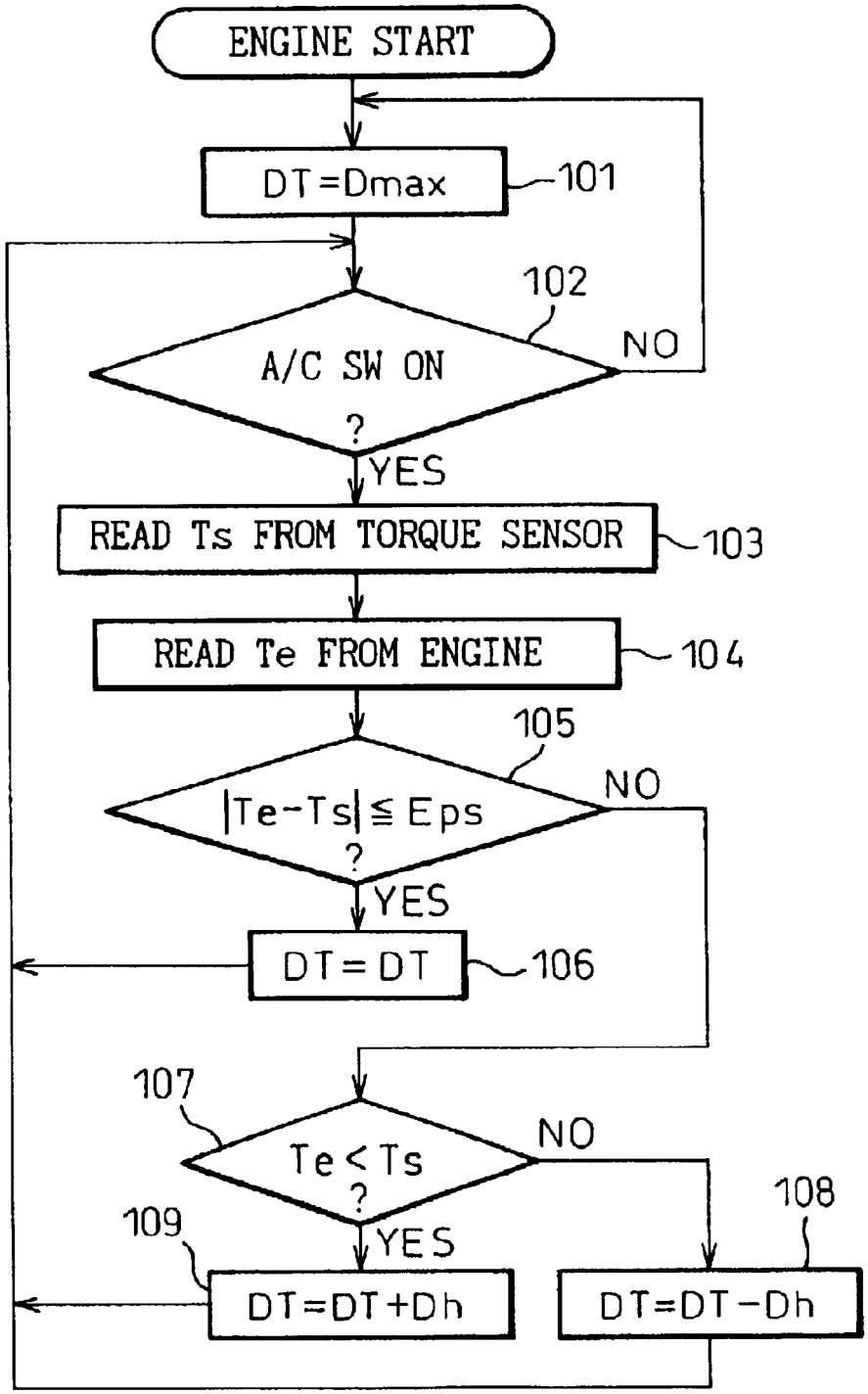
FIG. 8 is a flow chart illustrating a routine for control at the time of control of the duty ratio of a capacity control valve.

The specific routine for control of the duty ratio able to be executed in the control unit 38 is illustrated in FIG. 8. In this case, the duty ratio of the time of continuously supplying power to the coil 59 of the capacity control valve 29 shown in FIG. 5 (time when continuously opening capacity control valve 29, in this embodiment, time maintaining the capacity of the swash plate type variable capacity compressor C1 at substantially zero in the operating state) is made "1". This also means continuously maintaining the state shown in FIG. 3 or FIG. 5. Note that the swash plate type variable capacity compressor in this case may be a so-called clutchless type not provided with anything like an electromagnetic clutch.

The control program shown in FIG. 8 is executed repeatedly every short time period by the control unit 38 from when the engine starts to be started up. At the time of engine startup, it is preferable to facilitate the startup by keeping the engine load as light as possible, so when startup procedures are initiated, the routine proceeds unconditionally to step 101, where the duty ratio (DT) is made the maximum Dmax, that is, "1". Due to this, the capacity control valve 29 enters a state as shown in FIG. 3 where it is continuously open, so the swash plate 6 of the compressor C1 of this embodiment enters a state of the minimum tilt angle as shown in FIG. 2 and the discharge capacity becomes substantially zero.

When a certain length of time passes from when the engine was stopped, however, the pressure of the discharge chamber 28 of the compressor C1 falls and becomes equal to the pressure in the suction chamber 27, so even if the capacity control valve 29 is opened at the time of startup, the pressure in the swash plate chamber 23 will not immediately rise by a large extent. Further, even in the state of suspension of operation, the spring 24 pushes the swash plate 6 in the axial direction, so all of the pistons 7 are pushed to the top dead center position through the swash plate 6 and the strokes of all of the pistons 7 become substantially zero. Therefore, the capacity of the compressor C1 also becomes substantially zero. Accordingly, since the compression reaction forces in all of the working chambers 22 also become substantially zero at the time of engine startup, even if the pressure in the swash plate chamber 23 does not rise, the swash plate 6 is maintained in a state of a zero tilt angle by the biasing force of the spring 24.

After the engine finishes being started up and the rotational speed of the shaft 4 rises, the swash plate 6 tends to naturally increase in tilt angle due to the nature of the link mechanism, so the pistons 7 start to reciprocate, though slightly, and a slight amount of refrigerant is sucked in and compressed. Due to this, the pressure of the discharge chamber 28 rises a little at a time. Refrigerant slightly raised in pressure in this way travels from the discharge chamber 28 through the capacity control valve 29 when open and is supplied to the swash plate chamber 23 where it pushes the pistons 7 from the rear, so as long as the capacity control valve 29 remains in the open state due to instruction from the control unit 38, the swash plate 6 is maintained stably in a state of a zero tilt angle.

At the next step 102, the control unit 38 judges if the switch of the air-conditioning system (A/C) is ON. When the judgement is "NO" (air-conditioning system is not being used), the routine returns to step 101, after which the above control and judgement routine is repeated. The capacity of the compressor C1 is maintained at zero during this time as well. When the switch of the air-conditioning system is turned to the ON side by an operator or automatically and the judgement at step 102 becomes "YES", the routine proceeds to step 103, where the detection value Ts of the torque sensor 32 is read. Further, at the next step 104, the instruction value Te from the vehicle or engine control unit 37 (FIG. 3) is read. Next, at step 105, it is judged if the absolute value of the difference between the detection value Ts of the torque and the instruction value Te (this may be made the magnitude of the torque able to be used for the engine to drive rotation of the compressor C1 in the operating state of the vehicle at that time) is smaller than a predetermined judgement value Eps.

When the judgement at step 105 is "YES", the routine proceeds to step 106, where the duty ratio DT of the drive signal to be supplied to the coil 59 of the capacity control valve 29 is maintained as it is. In this case, the duty ratio DT is left as "1" and the open state of the capacity control valve 29 is maintained, so the capacity of the swash plate type variable capacity compressor C1 becomes zero. That is, even when the switch of the air-conditioning system is ON, depending on the magnitude of the instruction value Te from the vehicle or engine control unit 37, the capacity of the compressor C1 will be left at zero to substantially suppress operation of the air-conditioning system and prevent the drive torque of the air-conditioning system (compressor C1) from burdening the engine. When the torque allowed for the compressor C1 by the engine is made the instruction value Te, if the detection value Ts of the actual torque is about the same as the instruction value Te, the operational control of the compressor C1 is maintained as it is.

When the judgement at step 105 is "NO", that is, when the absolute value of the difference between the instruction value Te and the detection value Ts differs so greatly as to exceed the judgement value Eps, the routine proceeds to step 107, where it is judged if the instruction value Te is smaller than the detection value Ts. When the judgement at step 107 is "NO" (the instruction value Te is larger than the detection value Ts), this means that the allowable torque is larger than the detected torque, so the routine proceeds to step 108, where the duty ratio DT is reduced by exactly the predetermined value Dh and the open time of the capacity control valve 29 is shortened. Due to this, the pressure in the swash plate chamber 23 of the compressor C1 falls, the discharge capacity increases, and the detection value Ts of the torque becomes larger. As explained above, the air-conditioning system first starts actual operation in the state directly after engine startup. After step 108, the routine returns to step 102, where the above control routine is repeated.

When the judgement at step 107 is "YES", the detected torque has exceeded the allowable torque, so the routine proceeds to step 109, where the duty ratio DT is increased by the predetermined value Dh, the pressure in the swash plate chamber 23 is raised, the capacity of the compressor C1 is reduced, and therefore the torque is reduced. Next, the routine returns to step 102, where the above control routine is repeated. Due to this, the torque of the compressor C1 falls and becomes about the same as the instruction value Te. Of course, at the time of startup, as explained above, the duty ratio DT is made the maximum "1" from the start and the actual operation of the air-conditioning system is suppressed, so the detection value Ts of the torque also is a value close to zero and therefore the duty ratio DT cannot be increased any further. Therefore, the processing of step 109 is effective in the state where the air-conditioning system is actually operating other than at times of startup. Note that the above-mentioned judgement value Eps and amount of change Dh of the duty ratio are set to suitable values from both aspects of the stability and response of control.

As clear from the above explanation, in the swash plate type variable capacity compressor C1 of the first embodiment, as shown in FIG. 3 and FIG. 4, the control unit 38 of the compressor C1 receives as input a detection signal of the torque sensor 32 provided on the shaft 4 of the compressor C1 and receives as input a signal from the vehicle or engine control unit 37. Further, the signal of the control unit 38 including the detection signal of the torque sensor 32 is input to the control unit 37. Therefore, the vehicle or engine control unit 37 detects the magnitude of the torque of the compressor C1, so optimal control of the engine in accordance with the magnitude of the torque of the compressor C1 becomes possible at the vehicle side.

Further, when the engine load becomes large such as at the time of acceleration of the vehicle, climbing a slope, etc., it is possible to control the capacity of the compressor C1 to change in accordance with the magnitude of the torque allowed by the engine due to the operating state of the vehicle, that is, the torque allowed for the engine to drive the compressor. By feedback control of the torque of the compressor in accordance with the operating state of the vehicle or engine in this way, it is possible to improve the fuel economy of the engine and the drivability of the vehicle. In addition, in this case, since a two-way solenoid valve —a simple structure, inexpensive valve—is used as the capacity control valve 29, the cost is reduced and the overall size reduced. Further, by control of the duty ratio of the capacity control valve 29, it becomes possible to steplessly control the capacity of the compressor and smoothly adjust the cooling capacity of the air-conditioning system.

While in the range able to be deduced from the explanation of the first embodiment given above, next, other embodiments of the present invention shown in FIG. 9 to FIG. 13 will be explained. First, the present invention, as shown by the second embodiment shown in FIG. 9, can be embodied as a variable capacity compressor of the so-called "rocking swash plate type". In the embodiments of the second embodiment on, portions substantially identical to the swash plate type variable capacity compressor C1 of the first embodiment shown in FIG. 1 to FIG. 4 etc. are assigned the same reference numerals and overlapping detailed explanations are omitted.

Figure 9:
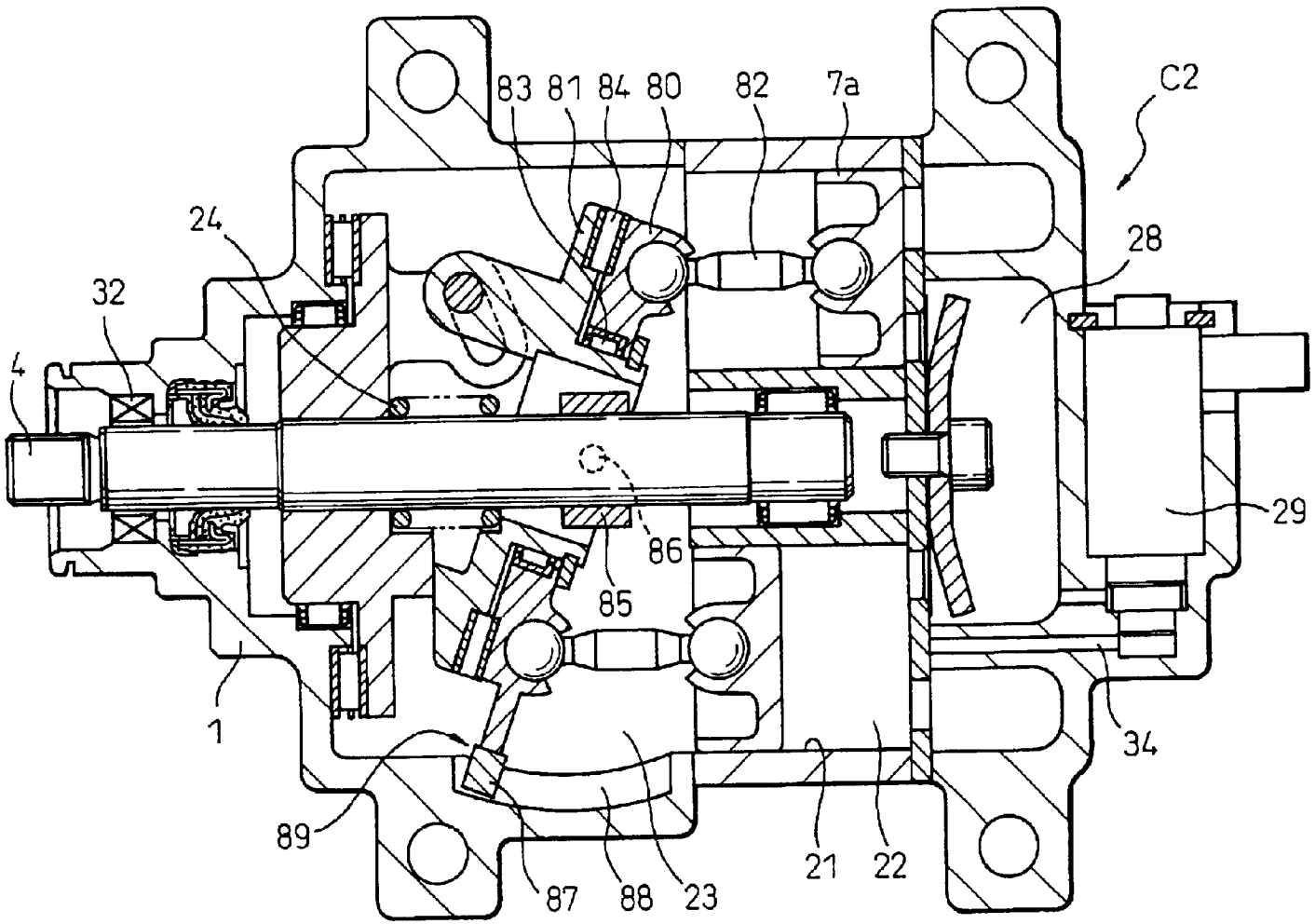
FIG. 9 is a longitudinal sectional view of the structure of a swash plate type variable capacity compressor according to a second embodiment of the invention in the state of operation at maximum capacity.

The variable capacity compressor C2 of the rocking swash plate type of the second embodiment shown in FIG. 9 is characterized in the point of use of the rocking swash plate 80. The rocking swash plate 80 differs from the swash plate 6 of the first embodiment in that it only tilts and rocks and does not rotate together with the shaft. Therefore, in the compressor C2 of the second embodiment, a swash plate support disk 81 similar to the above swash plate 6 rotating together with the shaft 4 is provided, and the rotating swash plate 80 is supported to be able to relatively rotate with respect to it through the radial bearing 83 and thrust bearing 84. Note that to prevent rotation of the rocking swash plate 80, a stop mechanism 89 is formed by forming an arm 87 at part of the rocking swash plate 80 and engaging this with an axial direction groove 88 formed at the inside surface of the front housing 1.

In the swash plate type variable capacity compressor C2 of the second embodiment, the rocking swash plate 80 does not rotate, so it is possible to simply connect it to the again not rotating pistons 7*a* using connecting rods 82. Therefore, in this case, there is no friction-sliding portion between the swash plate 6 and shoes 8 as in the first embodiment. Note that the swash plate support disk 81 is biased in the axial direction by the spring 24, but the disk 81 and the rocking swash plate 80 can be made to tilt with respect to the shaft 4 or can be made to move in the axial direction by pivoting the swash plate support disk 81 by a pin 86 etc. on a collar 85 loosely fit slidably on the shaft 4.

The swash plate type variable capacity compressor C2 of the second embodiment differs from the compressor C1 of the first embodiment in its detailed structure, but except for the advantages that the friction loss is relatively small etc., it basically acts in the same way as the swash plate type variable capacity compressor C1 of the first embodiment and exhibits generally the same effects. The same applies to the swash plate type variable capacity compressors of the third embodiment on explained from now.

Figure 10:
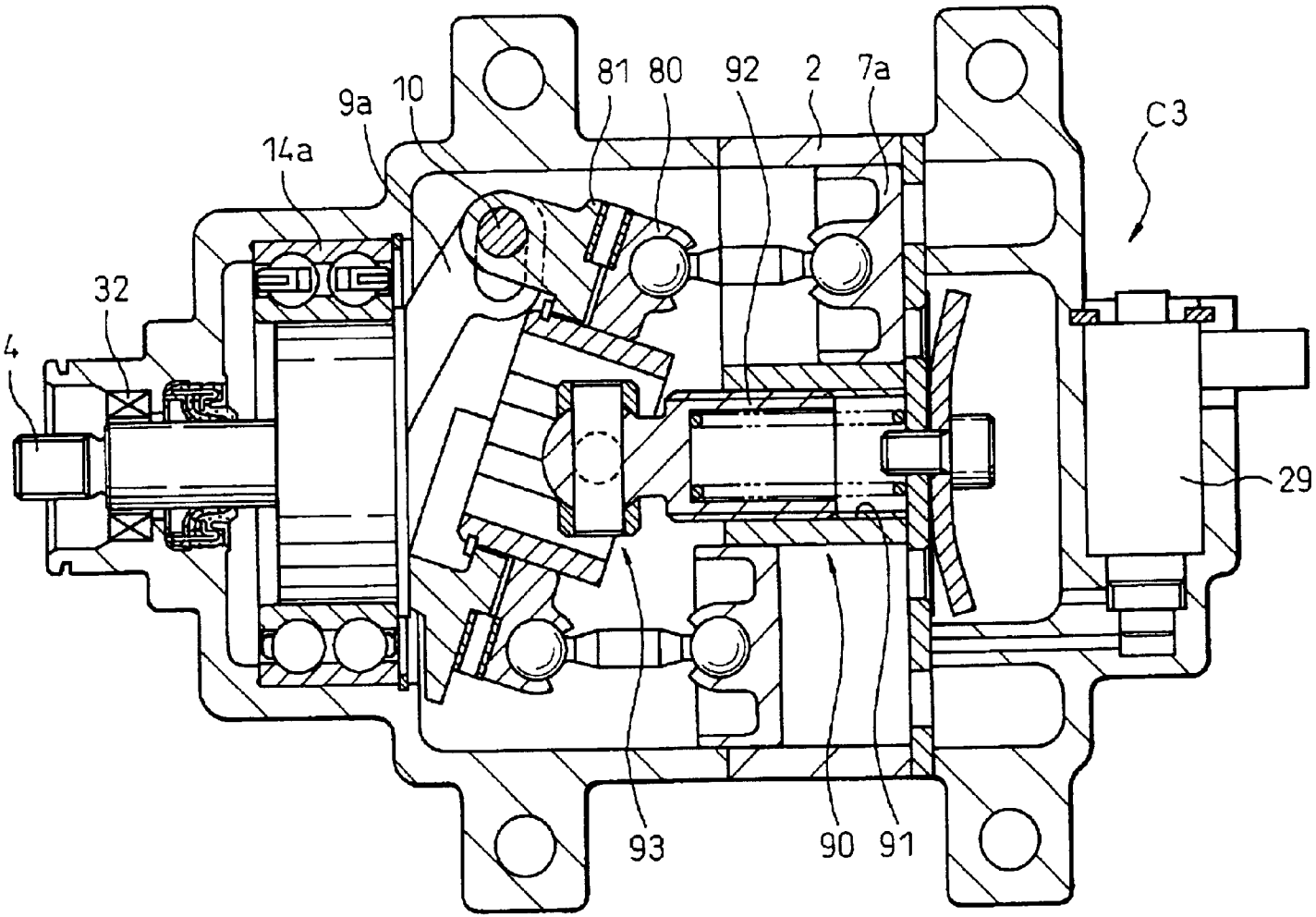
FIG. 10 is a longitudinal sectional view of the structure of a swash plate type variable capacity compressor according to a third embodiment of the invention in the state of operation at maximum capacity.

FIG. 10 shows a swash plate type variable capacity compressor C3 according to a third embodiment of the present invention. In this case as well, like in the compressor C2 of the above second embodiment, a rocking swash plate 80 and a swash plate support disk 81 are provided. The point of difference from the compressor C2 is that a stop mechanism 90 for the rocking swash plate 80 is provided at the center of the compressor C3. The stop mechanism 90 in the third embodiment is comprised of a spline hole 91 formed at the center of the middle housing 2, a spline shaft 92 able to fit in it and slide in the axial direction, and a free coupling 93 supporting the rocking swash plate 80 in a tiltable manner at its front end.

Further, by providing the stop mechanism 90 in the center of the middle housing 2, the portion supporting the swash plate support disk 81 etc. becomes a cantilever support structure, so a large radial bearing 14*a* is used in that case.

Figure 11:
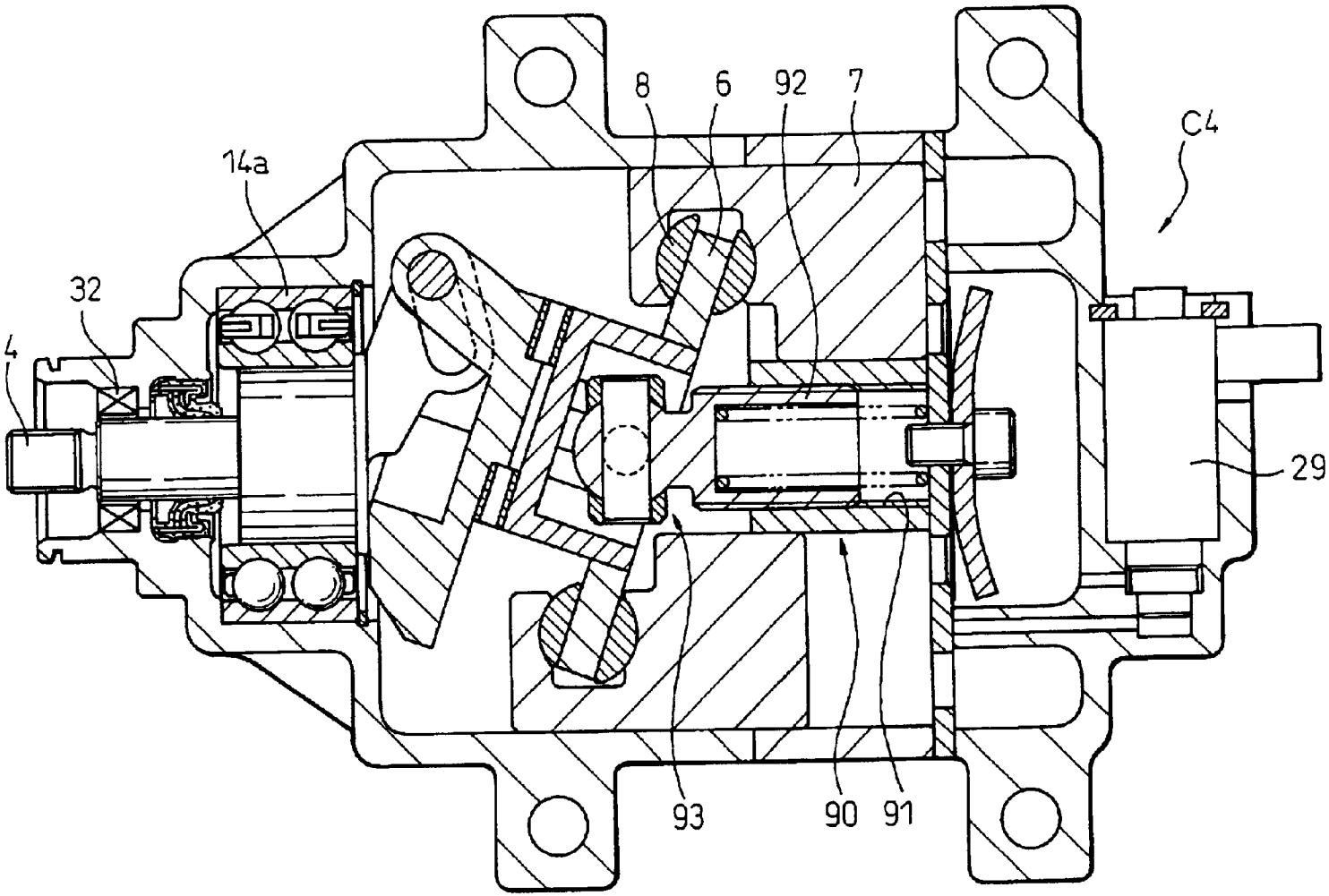
FIG. 11 is a longitudinal sectional view of the structure of a swash plate type variable capacity compressor according to a fourth embodiment of the invention in the state of operation at maximum capacity.

FIG. 11 shows a swash plate type variable capacity compressor C4 according to a fourth embodiment of the present invention. The compressor C4 of the fourth embodiment is a combination of parts of the compressor C1 of the first embodiment and the compressor C3 of the third embodiment. That is, in short, a rocking type swash plate 6 similar to that of the first embodiment is used, but the stop mechanism 90 etc. are similar to those of the third embodiment.

Figure 12:
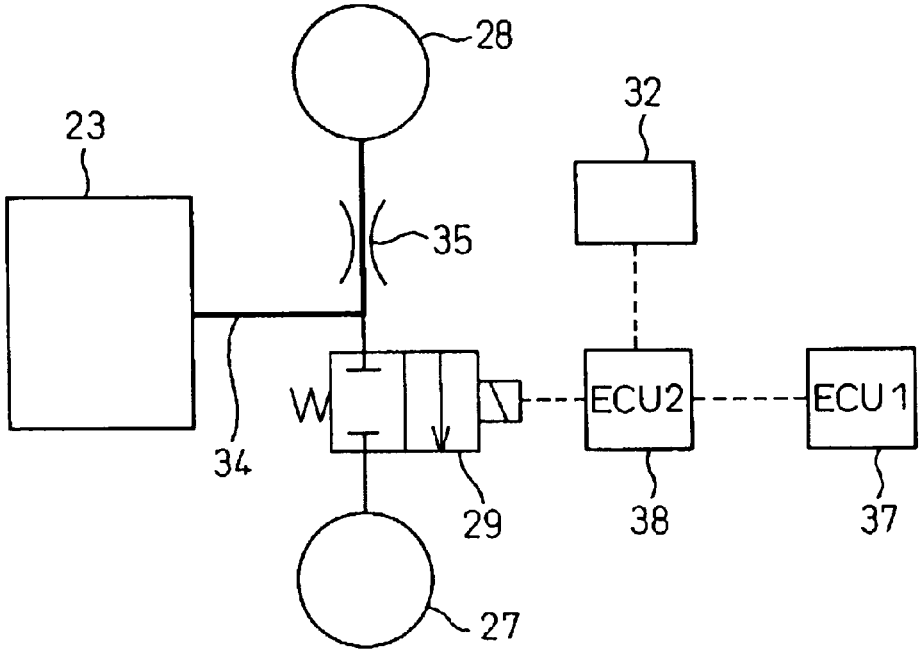
FIG. 12 is a schematic view of one detailed state of operation of the compressor of the fifth embodiment.
Figure 13:
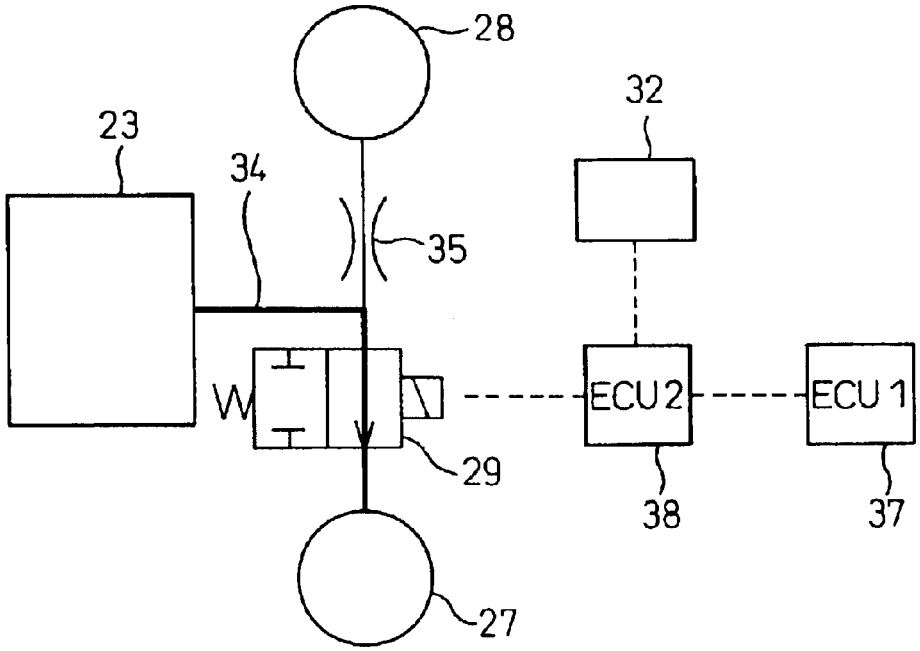
FIG. 13 is a schematic view of another detailed state of operation of the compressor of the fifth embodiment.

FIG. 12 and FIG. 13 show a fifth embodiment of the present invention. FIG. 12 shows the state where the capacity control valve 29 is closed. This corresponds to the minimum capacity operating state where the pressure (control pressure) of the swash plate chamber 23 of the not shown swash plate type variable capacity compressor becomes high. Further, FIG. 13 shows the state where the capacity control valve 29 is opened. This corresponds to the maximum capacity operating state where the pressure of the swash plate chamber 23 of the swash plate type variable capacity compressor becomes low. The fifth embodiment lacks any characterizing feature in the structure of the compressor body and is characterized by the point that the arrangement of the capacity control valve 29 and constricted passage 35 with respect to the suction chamber 27 and discharge chamber 28 of the compressor differs from that shown in FIG. 3 and FIG. 4 explained in relation to the first embodiment. Since there is no major change to the structure of the compressor itself, it is possible to obtain the compressor of the fifth embodiment by making a partial design change to any of the above compressors.

In the fifth embodiment, a constricted passage 35 is provided between the discharge chamber 28 and the swash plate chamber 23 as a feed path for control pressure to the swash plate chamber 23 of the compressor. Further, a capacity control chamber 29 is provided in the passage between the swash plate chamber 23 and the suction chamber 27 to form the discharge path. In this case as well, the capacity control valve 29 may be a two-way solenoid valve provided as the simple valve. Part of the pressurized refrigerant in the discharge chamber 28 is constricted by the constricted passage 35, then flows into the swash plate chamber 23 provided as the control pressure chamber. The outflow passage to the suction chamber 27 is opened and closed by the capacity control valve 29. The fact that the pressure of the swash plate chamber 23 changes due to the operation of the capacity control valve 29 requires no explanation. Needless to say, in the same way as the first embodiment, it is also possible to control the duty ratio of the capacity control valve 29. Compared with the case of FIG. 3 and FIG. 4 in the first embodiment, the positions of the constricted passage 35 and the capacity control valve 29 in one serial circuit have just been changed, so the actions and effects of the fifth embodiment are generally identical to those of the first embodiment.

Note that while the illustrated embodiments were explained with reference to a swash plate type of compressor, the present invention is not limited to a swash plate type. It may also be applied to a compressor of a different type such as a scroll type or vane type so as to change the pressure inside the control pressure chamber formed internally to change the discharge capacity.

While the invention has been described with reference to specific embodiments chosen for purpose of illustration, it should be apparent that numerous modifications could be made thereto by those skilled in the art without departing from the basic concept and scope of the invention.

What is claimed is:

1. A variable capacity compressor changed in discharge capacity by changing a pressure of a fluid acting in a control pressure chamber, wherein:

a valve for just opening and closing a passage is provided as a capacity control valve at one of a feed path for feeding a high-pressure fluid to said control pressure chamber and a discharge path for discharging the fluid from said control pressure chamber to a low-pressure side;

a constricted passage is formed at the other of the feed path and the discharge path;

a torque sensor is attached to a drive shaft and its detection value is input to a control unit, and the valve is operated by said control unit in accordance with the detection value of the torque sensor;

said fluid is a refrigerant in an air-conditioning system;

said air-conditioning system is installed in a vehicle;

said control unit is linked with a control unit of said vehicle or an engine mounted in the same, and the discharge capacity of said compressor is changed in accordance with an allowable value of torque for driving said compressor determined in accordance with at least an operating state of said vehicle or engine;

a control program to be executed by said control unit includes:

a step of starting control and setting a duty ratio of said valve to a predetermined value, for substantially minimizing the discharge capacity of the compressor at the time of engine startup;

a step of judging if said air-conditioning system is in an operating state;

a step of reading a detection value of said torque sensor when said air-conditioning system is in an operating state;

a step of reading an allowable value of torque from said vehicle or engine control unit;

a step of judging if an absolute value of the difference between a detection value of said torque and said allowable value is smaller than a predetermined value;

a step of maintaining a duty ratio of a drive signal supplied to said valve when said absolute value of the difference is smaller than a predetermined value;

a step of judging if said allowable value of the torque is smaller than said detection value when said absolute value of the difference is larger than a predetermined value;

a step of increasing said duty ratio of the valve by exactly a predetermined amount when said allowable value of the torque is smaller than said detection value; and a step of reducing said duty ratio of the valve by exactly a predetermined amount when said allowable value of the torque is larger than said detection value.

2. A variable capacity compressor as set forth in claim 1, wherein said high-pressure fluid is pressurized fluid in a discharge chamber.

3. A variable capacity compressor as set forth in claim 1, wherein a two-way solenoid valve is used as said valve.

4. A variable capacity compressor as set forth in claim 1, wherein said control unit is configured to control a duty ratio of said valve.

5. A variable capacity compressor as set forth in claim 1, wherein said control pressure chamber is a swash plate chamber.

6. A variable capacity compressor changed in discharge capacity by changing a pressure of a fluid acting in a control pressure chamber, wherein:

a valve for just opening and closing a passage is provided as a capacity control valve at one of a feed path for feeding a high-pressure fluid to the control pressure chamber and a discharge path for discharging the fluid from the control pressure chamber to a low-pressure region of the compressor;

a constricted passage is formed at the other path;

a torque sensor is attached to a drive shaft, and its detection value is input to a control unit, and the valve is operated by the control unit in accordance with the detection value of the torque sensor;

the fluid is a refrigerant in an air-conditioning system;

the air-conditioning system is installed in a vehicle, and the control unit is linked with a controller of the vehicle or a controller of an engine mounted in the vehicle;

the discharge capacity of the compressor is changed in accordance with an allowable value of torque for driving the compressor, and the allowable value of torque is determined in accordance with at least an operating state of the vehicle or engine; and a control program to be executed by the control unit includes:

controlling the valve to substantially minimize the discharge capacity of the compressor at the time of engine startup;

judging whether the air-conditioning system is in an operating state;

reading the detection value of the torque sensor when the air-conditioning system is in an operating state;

reading the allowable value of torque from the vehicle or engine controller;

judging whether an absolute value of the difference between the detection value of the torque and the allowable value is smaller than a predetermined value;

maintaining the state of the valve when the absolute value of the difference is smaller than a predetermined value;

judging whether the allowable value of the torque is smaller than the detection value when the absolute value of the difference is larger than a predetermined value;

increasing the discharge capacity of the compressor by a predetermined amount when the allowable value of the torque is smaller than the detection value; and reducing the discharge capacity of the compressor by a predetermined amount when the allowable value of the torque is larger than the detection value.

* * * * *